US008277040B2

(12) United States Patent
Ishida et al.

(10) Patent No.: US 8,277,040 B2
(45) Date of Patent: Oct. 2, 2012

(54) PRINTER

(75) Inventors: Tetsugo Ishida, Shiojiri (JP); Shun Oya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 237 days.

(21) Appl. No.: 12/715,349

(22) Filed: Mar. 1, 2010

(65) Prior Publication Data

US 2010/0220166 A1 Sep. 2, 2010

(30) Foreign Application Priority Data

Mar. 2, 2009 (JP) ..... 2009-047664

(51) Int. Cl.
*B41J 2/01* (2006.01)

(52) U.S. Cl. ..... 347/104; 347/102; 355/26; 271/197; 399/92

(58) Field of Classification Search ..... None
See application file for complete search history.

(56) References Cited

U.S. PATENT DOCUMENTS 3,922,083 A * 11/1975 Freeman et al. ..... 399/92
4,553,831 A * 11/1985 Dixon ..... 355/26
2002/0047885 A1* 4/2002 Miyawaki et al. ..... 347/104
2004/0245711 A1* 12/2004 Domoto et al. ..... 271/197
2007/0291096 A1* 12/2007 Toyoshima ..... 347/104

FOREIGN PATENT DOCUMENTS

JP 61-046498 A 3/1986
JP 2002-147396 A 5/2002

* cited by examiner

*Primary Examiner* — Matthew Luu
*Assistant Examiner* — John P Zimmermann
(74) *Attorney, Agent, or Firm* — Kilpatrick Townsend & Stockton LLP

(57) ABSTRACT

A printer has an exhaust path that rectifies the exhaust flow of a centrifugal fan for producing air flow through a vacuum platen. Exhaust from a centrifugal fan 30 tends to flow in the direction of rotation A of the blades due to inertia even after being discharged from the exhaust opening 39. The exhaust thus produces a curving exhaust current C. An exhaust duct 32 connected to the exhaust opening 39 of the centrifugal fan 30 therefore curves in the direction of rotation A of the blades so as to not impede the flow of the exhaust current C. As a result, turbulence inside the exhaust duct 32 is suppressed, and the exhaust current C is rectified. The exhaust from the centrifugal fan 30 can therefore flow smoothly, and a loss of exhaust flow can be suppressed. In addition, noise caused by the exhaust current C hitting the inside wall of the exhaust duct 32 can be suppressed.

5 Claims, 7 Drawing Sheets

PRINTER

This application claims priority under 35 U.S.C. §119 to Japanese Patent Application No. 2009-047664 filed on Mar. 2, 2009, the entire disclosure of which is expressly incorporated by reference herein.

BACKGROUND

1. Technical Field

The present invention relates to a printer that has a suction unit such as a vacuum platen that pulls the recording paper to the platen surface while the paper is conveyed, and relates more particularly to a printer having a ventilation path that rectifies the exhaust current of a centrifugal fan that produces air flow through the suction unit.

2. Related Art

Inkjet printers that have a vacuum platen to prevent the roll paper or other recording medium conveyed over the platen from lifting up and interfering with the nozzle surface of the inkjet print head are known from the literature. A vacuum platen has a suction unit with numerous air holes formed in the surface, and the suction unit is connected to the intake opening of a vacuum fan through an air path such as an air duct. When the vacuum fan operates, the suction unit produces an air flow that pulls the recording medium conveyed over the vacuum platen to the platen surface. A centrifugal fan such as a sirocco fan is commonly used as the vacuum fan.

Japanese Unexamined Patent Appl. Pub. JP-A-2002-147396 teaches an inkjet printer that has a vacuum platen. More particularly, JP-A-2002-147396 teaches technology for reducing turbulence in the flow of air pulled into the intake opening of the centrifugal fan so that air can be pulled in efficiently by the vacuum fan.

If an exhaust path is formed on the downstream side of the exhaust opening of the centrifugal fan and the exhaust flow produced by air discharge is rectified, the exhaust can flow smoothly and the centrifugal fan can pull air in efficiently.

However, the exhaust from the centrifugal fan tends to continue flowing along the rotating path of the fan blades even after the exhaust is discharged from the exhaust opening due to inertia. As a result, if the exhaust path is not suitably disposed, the exhaust flow becomes turbulent inside the exhaust path, inhibiting a smooth discharge, inviting loss of exhaust flow, and reducing fan performance. Another problem is that the turbulence produced in the exhaust path hits the inside walls of the exhaust path and produces noise.

SUMMARY

A printer according to the present invention has an exhaust path that rectifies the exhaust flow of a centrifugal fan for producing air flow through a vacuum platen.

A printer according to a first aspect of the invention has a centrifugal fan for producing air flow in a vacuum unit, and an exhaust path that curves from the exhaust opening of the centrifugal fan in the direction of rotation of the centrifugal fan blades.

Because the exhaust path disposed on the downstream side of the exhaust opening of the centrifugal fan curves in the direction of rotation of the blades of the centrifugal fan in a printer according to the invention, the production of turbulence inside the exhaust path can be prevented or suppressed. More specifically, exhaust from the centrifugal fan tends to continue flowing in the direction of rotation of the blades even after being discharged from the exhaust opening due to inertia, and produces an exhaust current that curves along the direction of rotation of the fan blades. The exhaust path curves so as to not impede this flow of the exhaust current. Little turbulence is therefore produced inside the exhaust path, and the exhaust current is rectified. As a result, the exhaust from the centrifugal fan flows smoothly, a loss of exhaust flow can be prevented, and fan performance is not impeded. In addition, power consumption by the fan can be suppressed, and noise resulting from the exhaust current hitting the inside walls of the exhaust channel can also be suppressed.

In order to discharge the exhaust from the printer from below the printer, the centrifugal fan is disposed with the axis of rotation of the blades extending in a first horizontal direction, and the exhaust opening opening in a second horizontal direction that is perpendicular to the first horizontal direction; and the exhaust path includes an exhaust duct of which the intake-side opening is connected to the exhaust opening, and the exhaust-side opening faces the opposite direction as the exhaust opening at a position below the exhaust opening.

Further preferably, the printer also has a printer frame to which the centrifugal fan is attached; a roll paper compartment formed inside the printer; a vacuum platen having the vacuum unit; an access cover that is disposed to open and close to the printer frame for opening and closing the roll paper compartment, and has the vacuum platen mounted thereon; and an intake path that can connect and disconnect the intake opening of the centrifugal fan and the vacuum unit of the vacuum platen.

When thus configured, even when the vacuum platen can move in conjunction with the access cover opening and closing, the intake path can be rendered with a length corresponding to the distance between the vacuum unit of the vacuum platen and the intake opening of the centrifugal fan when the access cover is closed. More specifically, by rendering the intake path short inside the printer frame, the flow resistance of the intake path can be reduced. As a result, the intake efficiency of the centrifugal fan can be improved.

Further preferably, the intake path includes an intake duct, and when the access cover opens, the intake duct is disconnected from the vacuum unit.

EFFECT OF THE INVENTION

Because the exhaust path disposed on the downstream side of the exhaust opening of the centrifugal fan curves in the direction of rotation of the blades of the centrifugal fan in a printer according to the invention, the production of turbulence inside the exhaust path can be prevented or suppressed. More specifically, exhaust from the centrifugal fan tends to continue flowing in the direction of rotation of the blades even after being discharged from the exhaust opening due to inertia, and produces an exhaust current that curves along the direction of rotation of the fan blades. The exhaust path curves so as to not impede this flow of the exhaust current. Little turbulence is therefore produced inside the exhaust path, and the exhaust current is rectified. As a result, the exhaust from the centrifugal fan flows smoothly, a loss of exhaust flow can be prevented, and fan performance is not impeded. In addition, power consumption by the fan can be suppressed, and noise resulting from the exhaust current hitting the inside walls of the exhaust channel can also be suppressed.

The printer according to the invention preferably has an inkjet print head. The air flow produced by the centrifugal fan can hold the recording medium to the vacuum unit of the vacuum platen positioned opposite the inkjet print head, and can recover ink mist in the ink mist recovery unit.

Other objects and attainments together with a fuller understanding of the invention will become apparent and appreciated by referring to the following description and claims taken in conjunction with the accompanying drawings.

DESCRIPTION OF EXEMPLARY EMBODIMENTS

A roll paper printer according to a preferred embodiment of the present invention is described below with reference to the accompanying figures.

General Configuration

Figure 1:
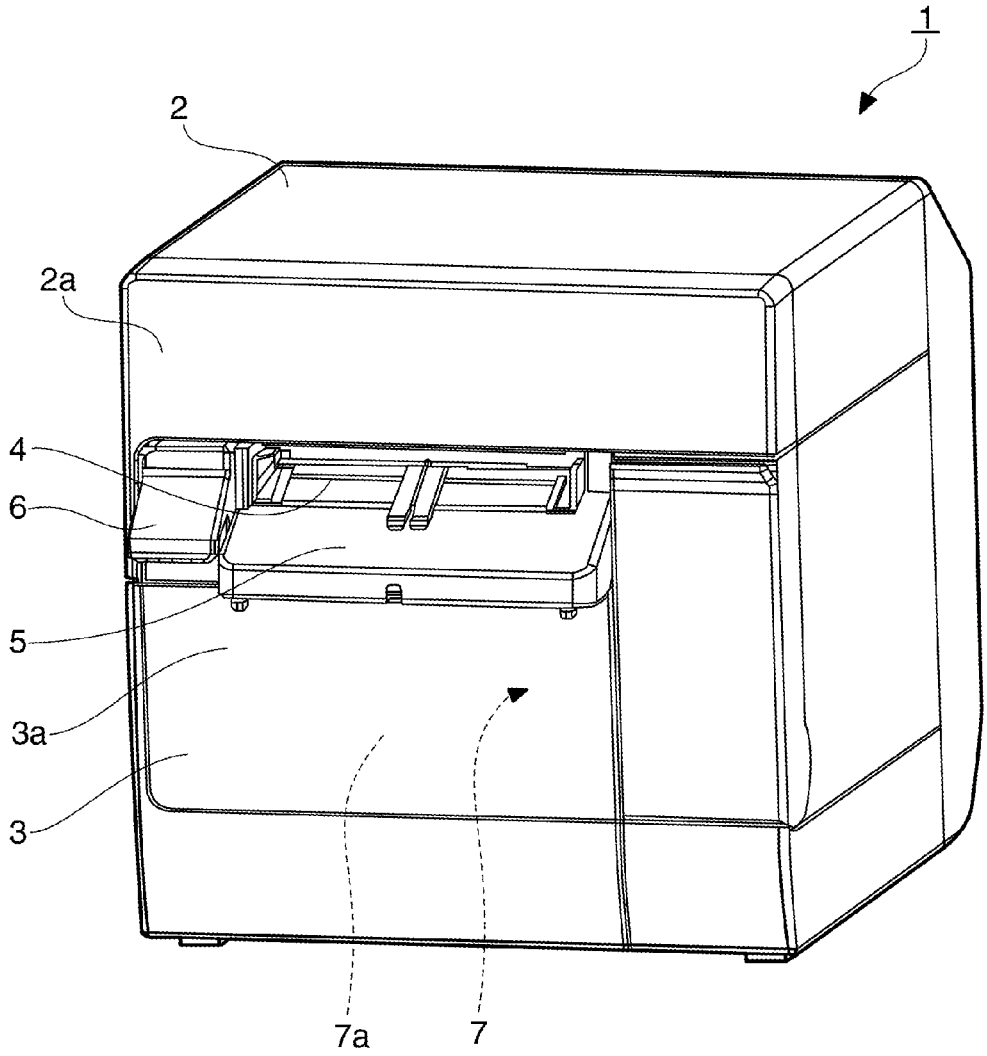
FIG. 1 is an external oblique view of a roll paper printer according to a preferred embodiment of the invention.
Figure 2:
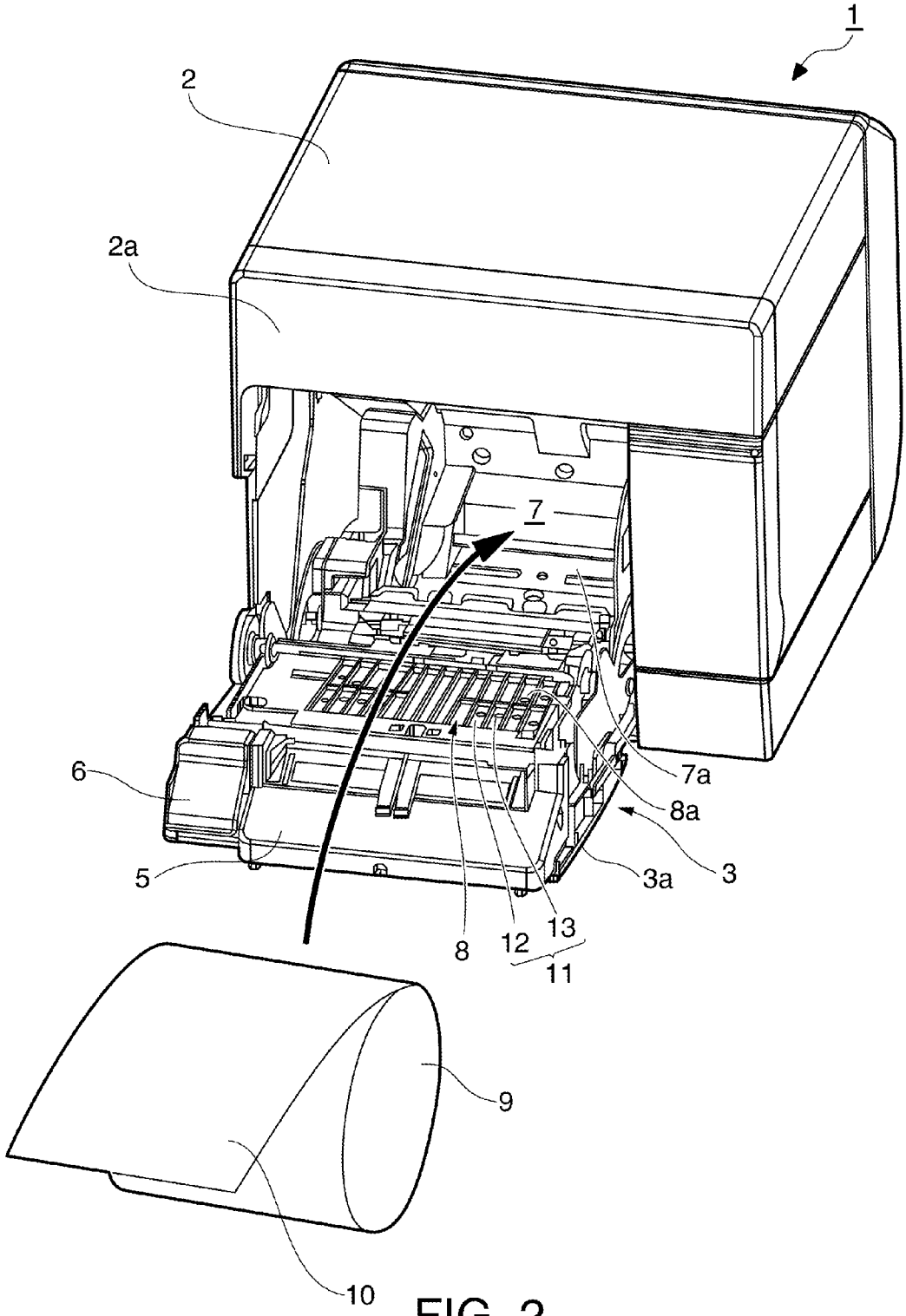
FIG. 2 is an external oblique view of the roll paper printer with the access cover open.

FIG. 1 is an external oblique view of a roll paper printer according to a first embodiment of the invention. FIG. 2 is an external oblique view of the printer with the cover completely open.

The roll paper printer 1 has a rectangular box-like body 2 and an access cover unit 3 that opens and closes and is disposed to the front of the body 2. The access cover unit 3 includes an access cover 3*a* and an opening/closing mechanism for the access cover 3*a*. A paper exit 4 of a specific width is formed at the front of the outside case 2*a* of the printer body 2. An exit guide 5 projects to the front from the bottom of the paper exit 4, and a cover opening/closing lever 6 is disposed beside the exit guide 5. A rectangular opening 7*a* for loading and removing roll paper in the roll paper compartment rendered inside the printer case 2 is formed in the outside case 2*a* below the exit guide 5 and cover opening/closing lever 6. This opening 7*a* is closed by the access cover 3*a*.

Operating the cover opening lever 6 releases the lock holding the access cover unit 3 closed. After the lock is released and the exit guide 5 disposed to the access cover unit 3 is pulled forward, the access cover unit 3 pivots at the bottom end thereof and opens forward to a substantially horizontal position as shown in FIG. 2. Opening the access cover unit 3 opens the roll paper compartment 7. At the same time, the vacuum platen 8 that defines the printing position moves with the access cover unit 3, and the recording medium transportation path opens from the roll paper compartment 7 to the paper exit 4. This enables easily loading or replacing the roll paper 9 from the front of the printer.

A vacuum unit 11 for holding a continuous recording medium 10 delivered from the roll paper 9 is formed in the surface 8*a* of the vacuum platen 8. The vacuum unit 11 has a plurality of channel-shaped vacuum areas 12 separated by a plurality of ribs, and intake holes 13 formed in the bottoms of the vacuum areas 12.

Internal Configuration

Figure 3:
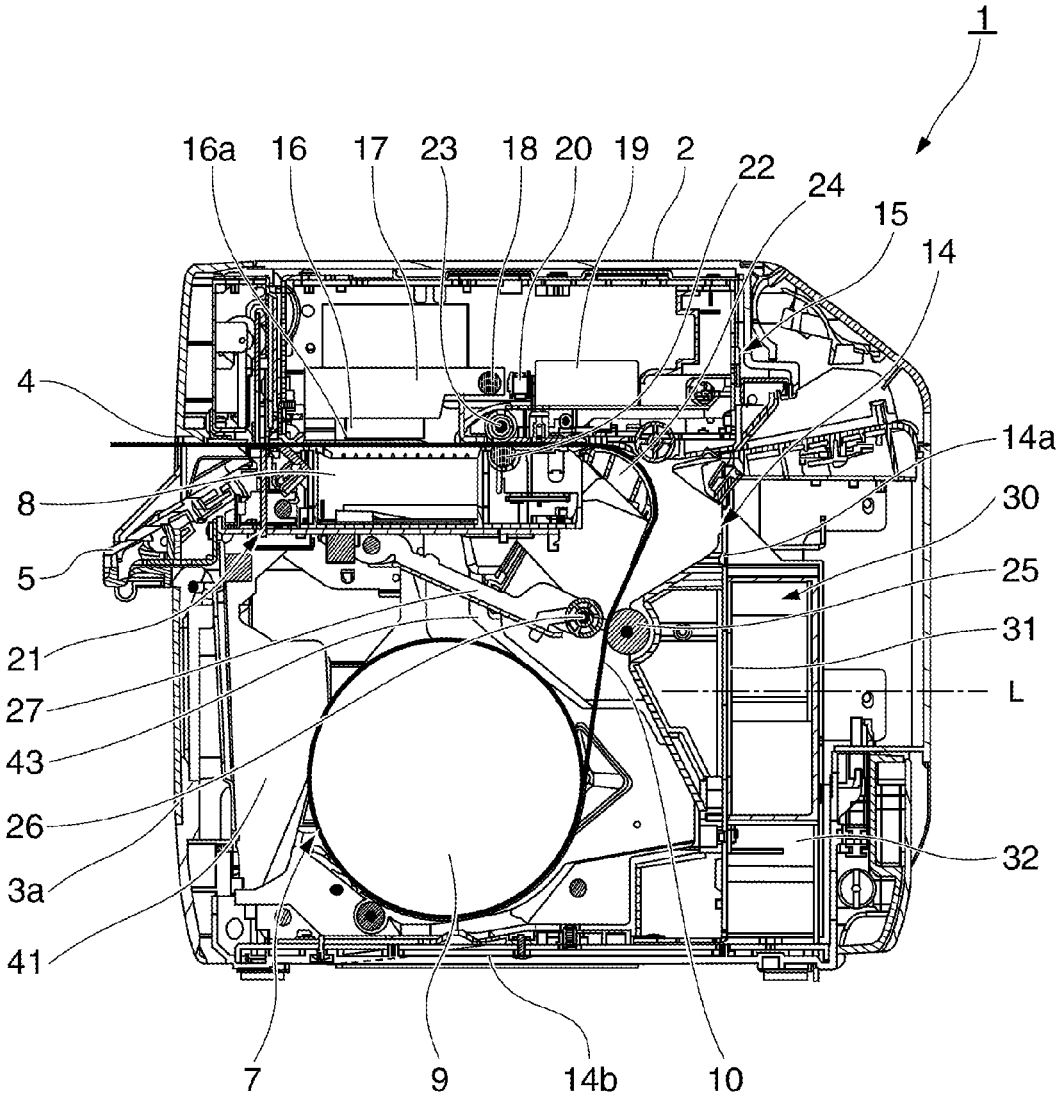
FIG. 3 is a schematic vertical section view showing the internal structure of the roll paper printer.

FIG. 3 is a schematic vertical section view showing the internal configuration of the roll paper printer 1, and shows the roll paper compartment 7 from the right side of the printer.

A roll paper compartment 7 is formed in the center between the side walls of the printer frame 14 inside the roll paper printer 1. The roll paper 9 is stored on its side in the roll paper compartment 7 with the center axis of the roll paper 9 aligned with the width of the printer.

A head unit frame 15 is disposed horizontally at the top of the printer frame 14 above the roll paper compartment 7. Disposed to the head unit frame 15 are a carriage 17 that carries an inkjet print head 16, and a carriage guide shaft 18 that guides movement of the carriage 17 widthwise to the printer. The inkjet print head 16 is mounted on the carriage 17 with the ink nozzle surface 16*a* facing down. The carriage guide shaft 18 extends horizontally widthwise to the printer. A carriage transportation mechanism including a carriage motor 19 and timing belt 20 for moving the carriage 17 bidirectionally along the carriage guide shaft 18 is also disposed to the head unit frame 15.

A platen frame 21 extending horizontally in the front-back direction of the printer is disposed below the inkjet print head 16. A vacuum platen 8 is disposed horizontally widthwise to the printer on the platen frame 21. The vacuum platen 8 defines the printing position of the inkjet print head 16 at a position opposite the inkjet print head 16 with a specific gap therebetween.

A paper feed roller 22 extends horizontally widthwise to the printer behind the vacuum platen 8. A first pressure roller 23 of a specific width applies specific pressure to the paper feed roller 22. The paper feed roller 22 is driven rotationally by a paper feed motor not shown that is mounted on the printer frame 14.

A tension guide 24 that curves down is located at the back end of the platen frame 21. The recording medium 10 delivered from the roll paper 9 loaded in the roll paper compartment 7 travels diagonally upward and then curves around the tension guide 24. The recording medium 10 is then conveyed through a paper transportation path that extends horizontally to the paper exit 4.

A delivery roller 25 is disposed horizontally widthwise to the printer below the tension guide 24. The delivery roller 25 delivers the recording medium 10 from the roll paper compartment 7, and is located upstream from the tension guide 24 on the paper transportation path. The delivery roller 25 is driven rotationally by a feed motor not shown. A second pressure roller 26 of a specific width is pressed to the delivery roller 25 so that it rotates in conjunction therewith. This second pressure roller 26 is attached to the distal end part of a pressure lever 27 that is attached extending to the back below the vacuum platen 8. The second pressure roller 26 is pressed to the delivery roller 25 as a result of the pressure lever 27 being urged down by a spring force.

When the access cover unit 3 opens, the vacuum platen 8, the tension guide 24, the paper feed roller 22, the pressure lever 27, and the second pressure roller 26 move forward in conjunction with the access cover 3*a*.

A centrifugal fan 30 for pulling air through the vacuum unit 11 of the vacuum platen 8 is disposed on the back side of the back panel portion 14*a* of the printer frame 14 at the back of the roll paper compartment 7. The centrifugal fan 30 is disposed with the axis of rotation L of the blades aligned with the front-back axis of the printer case 2, and the intake opening 31 facing the front.

An intake path is formed between the vacuum unit 11 of the vacuum platen 8 and the intake opening 31 of the centrifugal fan 30. An exhaust duct 32 is attached to the centrifugal fan 30, and an exhaust path is formed by the exhaust duct 32. When the centrifugal fan 30 operates, air is pulled in by the vacuum unit 11 through the intake path, and the recording medium 10 traveling over the vacuum platen 8 is pulled thereto. Exhaust from the centrifugal fan 30 is vented through the exhaust path.

The part of the recording medium 10 pulled from the roll paper 9 is conveyed passed the printing position while being held to the surface 8*a* of the vacuum platen 8. Content is printed by inkjet print head 16 at the printing position while the carriage 17 travels bidirectionally on the carriage guide shaft 18. After printing a line widthwise to the recording medium 10 ends, the paper feed roller 22 and delivery roller 25 are driven rotationally and the recording medium 10 is advanced a specific pitch. The next line is then printed. The recording medium 10 is thus printed by the inkjet print head 16 while being intermittently advanced a specific pitch.

Intake Path

Figure 4:
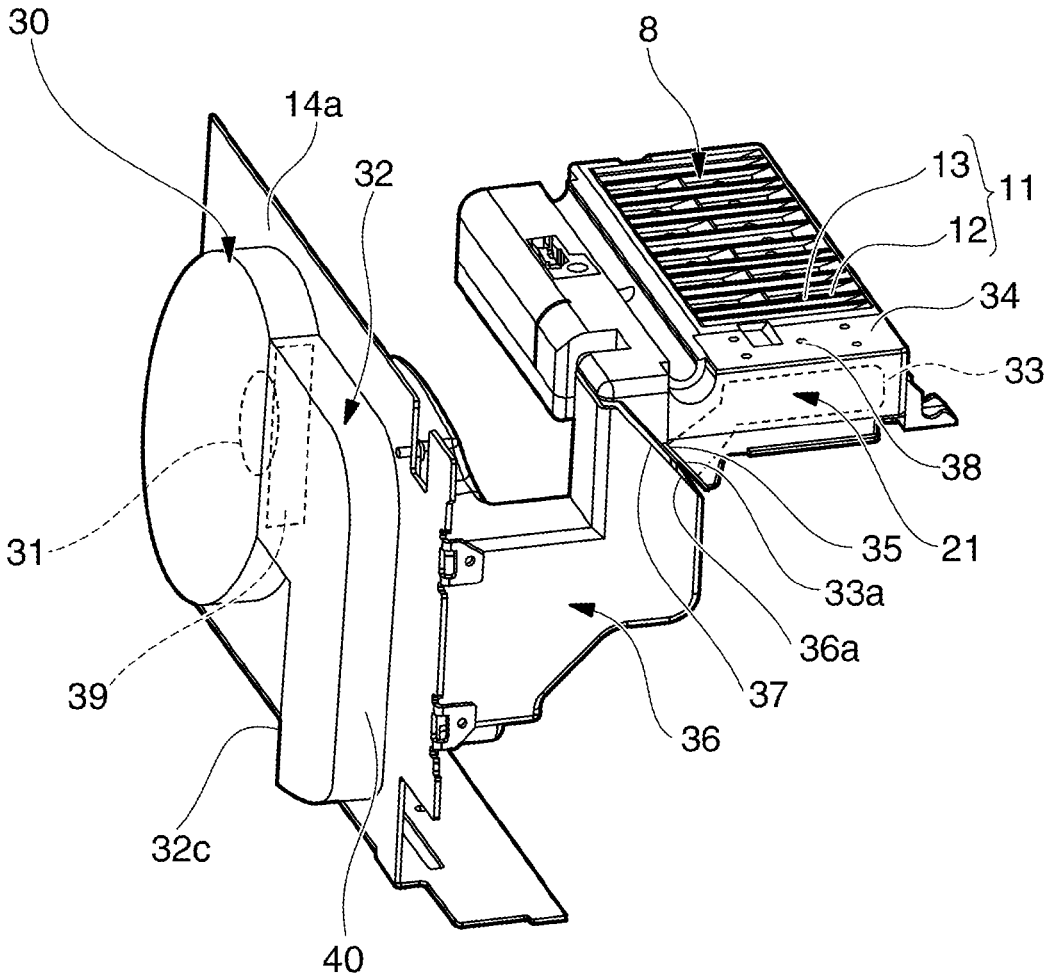
FIG. 4 is a partial oblique view of the intake path and the exhaust path.

The intake path is described next with reference to FIG. 4. FIG. 4 is a partial oblique view showing the platen frame 21, the 36, the centrifugal fan 30, and the exhaust duct 32.

The inside of the vacuum platen 8 is hollow. This hollow part is a vacuum platen-side air channel 33 that communicates with the vacuum areas 12 through the intake holes 13. An ink mist recovery unit 34 that recovers ink mist resulting from the ink droplets discharged from the inkjet print head 16 is formed in the platen frame 21 beside the vacuum platen 8 using the space enabling movement of the carriage 17 carrying the inkjet print head 16. The vacuum platen-side open end 33*a* of the vacuum platen-side air channel 33 is formed at a position below the back end of the ink mist recovery unit 34, that is, at a position offset to the side from the printing area. This vacuum platen-side open end 33*a* is inclined down and to the back, and a gasket 35 is attached thereto.

The upstream end opening of the vacuum platen-side air channel 33 and the intake opening 31 of the centrifugal fan 30 are connected by an intake duct 36. One open end of the intake duct 36 is attached to the back panel portion 14*a* so that it connects to the intake opening 31 of the centrifugal fan 30. The side of the intake duct 36 between the one open end and the other open end has an L-shape that curves upward after extending the side of the roll paper compartment 7 along the side of the printer case 2 to the front at the back side of the ink mist recovery unit 34. The duct opening 36*a* formed at the end of the curved portion inclines facing upward and to the front, and a gasket 37 is attached thereto. The width of the intake duct 36 and the width of the ink mist recovery unit 34 are substantially the same. The intake duct 36 is rectangular in section.

When the access cover 3*a* is closed, the platen frame 21 is held substantially horizontal and the vacuum platen 8 is positioned to define the printing position as shown in FIG. 4. In this position the vacuum platen-side open end 33*a* and the duct opening 36*a* meet with an airtight connection through the gaskets 35 and 37. The vacuum unit 11 in the surface 8*a* of the vacuum platen 8 is thus connected to the intake opening 31 of the centrifugal fan 30 through the intake path rendered by the vacuum platen-side air channel 33 and the intake duct 36.

Because the vacuum platen 8 moves to the front of the printer case 2 in conjunction with the access cover unit 3 when the access cover 3*a* is opened, the vacuum platen-side open end 33*a* and the duct opening 36*a* are disconnected. As a result, the intake opening 31 of the centrifugal fan 30 and the vacuum unit 11 of the vacuum platen 8 are disconnected.

Note that the ink mist recovery unit 34 has mist intake holes 38 for pulling in ink mist. These mist intake holes 38 communicate with the vacuum platen-side air channel 33. A vacuum mechanism for recovering ink mist is thus rendered using the vacuum platen-side air channel 33, intake duct 36, and centrifugal fan 30 for pulling the recording medium 10 to the surface 8*a* of the vacuum platen 8.

Exhaust Path

Figure 5:
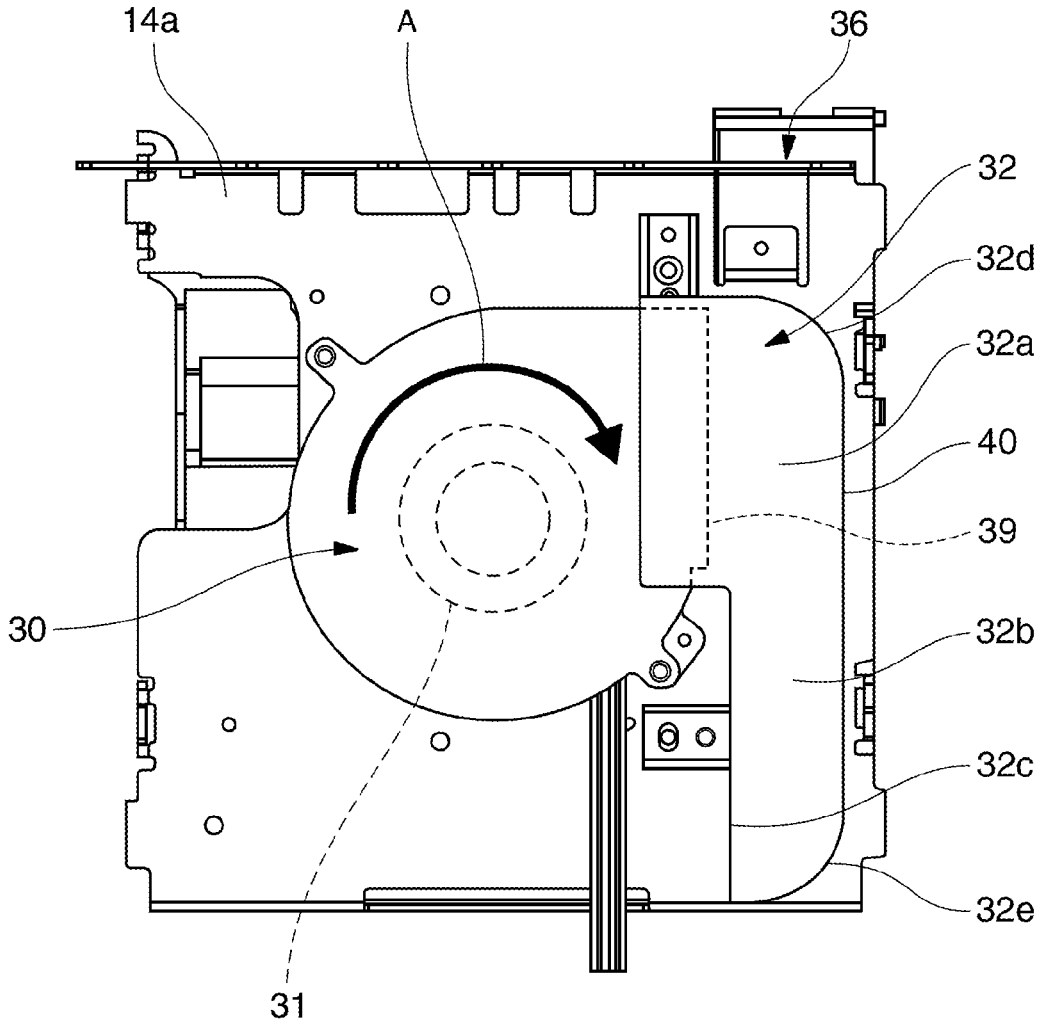
FIG. 5 is a plan view from the back side of the centrifugal fan and exhaust duct.

The exhaust path is described next with reference to FIG. 4 and FIG. 5. FIG. 5 is a plan view of the centrifugal fan 30 and the exhaust duct 32 from the back side of the printer frame 14.

The exhaust opening 39 of the centrifugal fan 30 faces a widthwise side of the printer above the printer frame 14. The exhaust duct 32 connected to the exhaust opening 39 curves in the direction of rotation A of the blades of the centrifugal fan 30. The exhaust duct 32 has a duct cover 40 that is U-shaped in section and is attached to the back side of the back panel portion 14*a* to cover the exhaust opening 39 of the centrifugal fan 30. The exhaust duct 32 is rendered between the duct cover 40 and the back of the back panel portion 14*a*.

The exhaust duct 32 includes a horizontal duct portion 32*a* that covers the exhaust opening 39 and extends in the direction the exhaust opening 39 is facing; a vertical duct portion 32*b* that extends downward continuously to the horizontal duct portion 32*a*; and an exhaust vent 32*c* that is formed at the bottom end part of the vertical duct portion 32*b* facing the opposite direction as the exhaust opening 39. The corner portion 32*d* connecting the horizontal duct portion 32*a* and the vertical duct portion 32*b* has a curved inside wall surface that curves down. The bottom end corner part 32*e* of the vertical duct portion 32*b* has a curved inside wall surface that curves to the side. The exhaust vent 32*c* faces the opposite direction as the exhaust opening 39 at a position below the exhaust opening 39.

When the centrifugal fan 30 is driven with the vacuum unit 11 of the vacuum platen 8 and the intake opening 31 of the centrifugal fan 30 connected through the intake path rendered by the vacuum platen-side air channel 33 and the intake duct 36, air is pulled in from the vacuum areas 12 of the vacuum unit 11 and is discharged from the exhaust opening 39 of the centrifugal fan 30. As a result, negative pressure is produced in each of the vacuum areas 12, and the recording medium 10 is pulled to the surface 8*a* of the vacuum platen 8. The exhaust pushed out from the exhaust opening 39 is forced out from the exhaust vent 32*c* through the exhaust duct 32, and is discharged from below the printer case 2.

Figure 6:
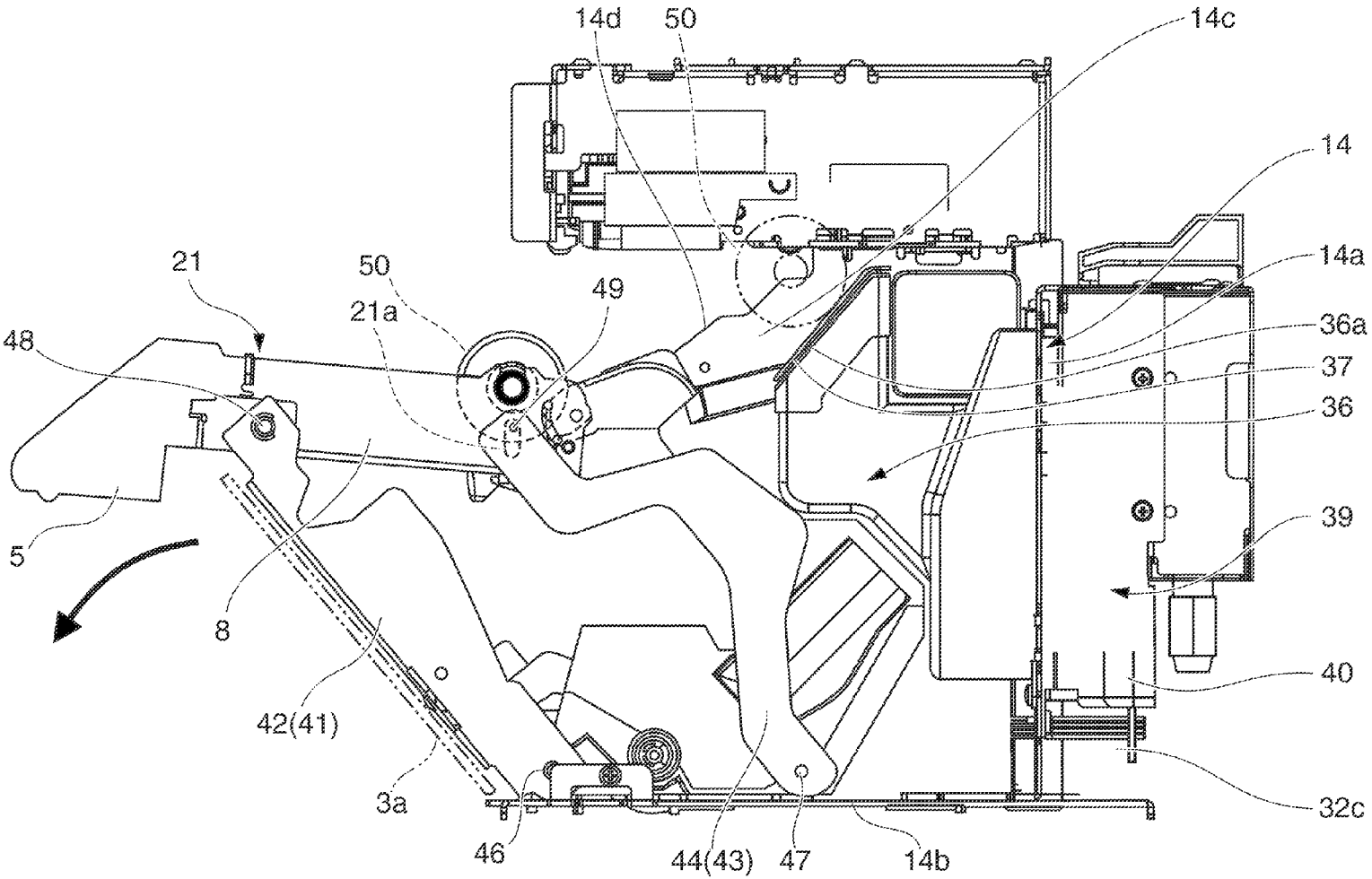
FIG. 6 is schematic side view of the printer when the access cover is partially open.

The opening and closing mechanism of the access cover unit 3 is described next with reference to FIG. 3 and FIG. 6. FIG. 6 is a schematic side view showing the opening and closing mechanism of the access cover unit 3, and shows the access cover unit 3 pulled forward. Note that the access cover 3*a* of the access cover unit 3 is not shown in FIG. 6.

The access cover unit 3 is supported on the printer case 2 so that the cover unit can open and close by means of a four-node parallel linkage mechanism.

This parallel linkage mechanism includes a pair of left and right front parallel links 41 and 42 to which the access cover 3*a* is attached, and a pair of left and right rear parallel links 43 and 44. (FIG. 6 shows the front parallel link 42 and the rear parallel link 44 that are positioned on the right side when looking at the front of the printer.) The access cover 3*a* is attached between the front parallel links 41 and 42.

The bottom end parts of the front parallel links 41 and 42 are supported by the bottom panel part 14*b* of the printer frame 14 to pivot freely forward and back on a horizontal shaft 46. The rear parallel links 43 and 44 are also supported by the bottom panel part 14*b* to pivot freely forward and back on a horizontal shaft 47.

The top end parts of the front parallel links 41 and 42 are connected freely pivotably on a horizontal shaft 48 to the front end parts of the platen frame 29. The top ends of the rear parallel links 43 and 44 and the back end of the platen frame 21 are coupled so that a specific amount of vertical motion is possible. An oval hole 21*a* is formed in the side of the platen frame 21 with the long axis of the hole vertical, and the horizontal shaft 49 attached to the top end parts of the rear parallel links 43 and 44 is inserted here so that the horizontal shaft 49 can rotate freely and slide.

An inclined shoulder 14*d* for positioning is formed sloping upward from the front to the back on a side panel part 14*c* of the printer frame 14 on the left side of the roll paper compartment 7 so that a guide roller 50 for positioning can ride up to a position in the middle of the inclined shoulder 14*d*. The guide roller 50 projects to the left from the left side of the platen frame 21 as seen from the front of the printer. This guide roller 50 is attached freely rotatably to the platen frame 21.

When the access cover unit 3 is closed, the guide roller 50 rides up the inclined shoulder 14*d*, thereby holding the platen frame 21 substantially horizontal and positioning the vacuum platen 8 attached thereto in the printing position opposite the nozzle surface of the inkjet print head 16 with a specific gap therebetween. The vacuum platen-side open end 33*a* of the vacuum platen-side air channel 33 and the duct opening 36*a* also contact with an airtight connection.

When the access cover unit 3 opens, parts including the vacuum platen 8, tension guide 24, and paper feed roller 22 disposed to the platen frame 21 also move forward. The access cover unit 3 moves forward pivoting on the horizontal shaft 46 of the front parallel links 41 and 42. The platen frame 21 disposed between the front parallel links 41 and 42 and the rear parallel links 43 and 44 also moves forward and down. As a result, the guide roller 50 of the platen frame 21 moves forward along the inclined shoulder 14*d*.

When the access cover unit 3 opens, the paper transportation path from the roll paper compartment 7 to the paper exit 4 also opens. The connection of the vacuum platen-side air channel 33 and the intake duct 36 is also interrupted. When the access cover unit 3 is opened further from the position shown in FIG. 6, the access cover unit 3 can be opened to the front horizontal position as shown in FIG. 2. In this open position the front parallel links 41 and 42 and the rear parallel links 43 and 44 on the platen frame 21 side are folded together substantially horizontally.

The operation of closing the access cover unit 3 from the open position is the reverse of the above operation. More specifically, just before the access cover unit 3 closes, the guide roller 50 of the platen frame 21 rides onto the inclined positioning shoulder 14*d* formed on the side panel part 14*c* of the printer frame 14. The guide roller 50 then engages the inclined shoulder 14*d*, and the platen frame 21 is set to a substantially horizontal position. As a result, the platen 8 is disposed to the printing position opposite the inkjet print head 16 with a specific gap therebetween as shown in FIG. 3. The vacuum platen-side open end 33*a* of the vacuum platen-side air channel 33 and the duct opening 36*a* also make airtight contact.

Operating Effect of the Exhaust Path

Figure 7A:
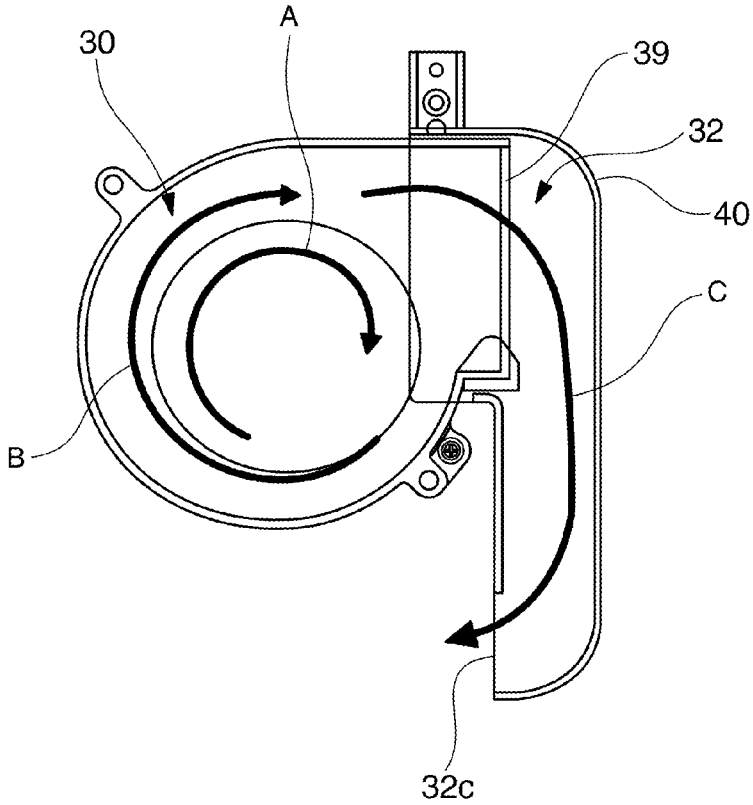
FIG. 7 describes the exhaust flow inside the exhaust duct.
Figure 7B:
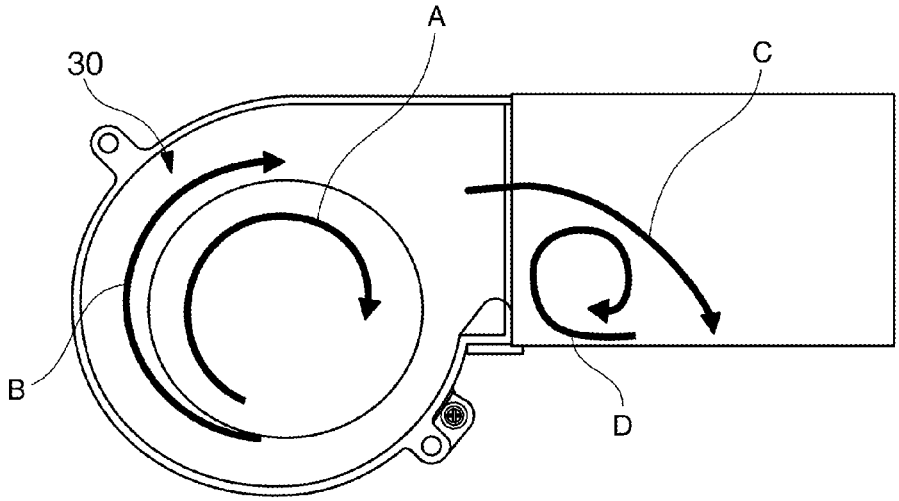

FIG. 7A schematically shows the exhaust flow in the exhaust path according to the invention. For comparison, FIG. 7B schematically shows the exhaust flow in the exhaust path when the exhaust path extends straight from the exhaust opening 39 of the fan.

A current B that flows in an eddy in the direction of rotation A of the fan blades is produced inside the centrifugal fan 30. As a result, exhaust from the centrifugal fan 30 produces a curving exhaust current C that tends to flow along the direction of rotation A of the blades due to inertia even after being discharged from the exhaust opening 39. The exhaust duct 32 is formed to curve in the direction of rotation A of the fan blades so that it does not impede this exhaust current C. As a result, as shown in FIG. 7A, the exhaust current C flows to the exhaust vent 32*c* through the exhaust duct 32.

For comparison, a configuration in which the exhaust path extends straight from the exhaust opening 39 is also considered. In this configuration, as shown in FIG. 7B, the exhaust current C collides with the side of the exhaust path because the current curves in a flow pattern following the direction of rotation A of the blades, and produces turbulence D.

Effect of the Embodiment

As described above, the exhaust current C is rectified by this embodiment of the invention because the exhaust duct 32 disposed on the downstream side of the exhaust opening 39 of the centrifugal fan 30 curves in the direction of rotation A of the blades of the centrifugal fan 30. Therefore, the exhaust from the centrifugal fan 30 flows smoothly, and a loss of exhaust flow can be prevented. As a result, power consumption by the centrifugal fan 30 can be reduced because fan performance is not impeded. Noise resulting from the exhaust current C hitting the inside walls of the exhaust duct 32 can also be suppressed.

In this embodiment of the invention the intake path enables connecting and disconnecting the intake opening 31 of the centrifugal fan 30 to the vacuum unit 11 of the vacuum platen 8. More specifically, when the access cover 3*a* is opened, the intake duct 36 connecting the intake opening 31 of the centrifugal fan 30 and the vacuum unit 11 of the vacuum platen 8 is disconnected. The intake duct 36 can therefore be rendered with a length corresponding to the distance between the intake opening 31 of the centrifugal fan 30 and the vacuum unit 11 of the vacuum platen 8 when the access cover 3*a* is closed. In addition, by rendering the intake path from the centrifugal fan 30 to the vacuum platen 8 through the intake duct 36 short, a drop in the exhaust flow can be reduced. As a result, the intake efficiency of the centrifugal fan 30 can be improved.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer comprising:

a centrifugal fan for producing air flow in a vacuum unit;

an exhaust path that curves from an exhaust opening of the centrifugal fan in the direction of rotation of the centrifugal fan blades a printer frame to which the centrifugal fan is attached;

a roll paper compartment formed inside the printer;

a vacuum platen having the vacuum unit;

an access cover that is disposed to open and close to the printer frame for opening and closing the roll paper compartment, and has the vacuum platen mounted thereon; and an intake path that can connect and disconnect the intake opening of the centrifugal fan and the vacuum unit of the vacuum platen, wherein the intake path includes an intake duct, and when the access cover opens, the intake duct is disconnected from the vacuum unit.

2. The printer described in claim 1, wherein:

the centrifugal fan is disposed with the axis of rotation of the blades extending in a first horizontal direction, and the exhaust opening opening in a second horizontal direction that is perpendicular to the first horizontal direction; and the exhaust path includes an exhaust duct of which an intake-side opening is connected to the exhaust opening, and an exhaust-side opening faces the opposite direction as the exhaust opening.

3. The printer described in claim 1, further comprising:

an inkjet print head.

4. The printer described in claim 1, wherein:

the centrifugal fan and the exhaust duct are disposed to the back side of the printer frame.

5. The printer described in claim 2, wherein:

the exhaust-side opening of the exhaust duct is positioned below the exhaust opening.

* * * * *